US006715528B2

(12) United States Patent
Rossini

(10) Patent No.: US 6,715,528 B2
(45) Date of Patent: Apr. 6, 2004

(54) ACTUATION ASSEMBLY FOR SHUTTERS INSIDE DOUBLE-GLAZING UNITS

(75) Inventor: Mauro Rossini, Este (IT)

(73) Assignee: Finvetro S.p.A., Monselice (IT)

( * ) Notice: Subject to any disclaimer, the term of this patent is extended or adjusted under 35 U.S.C. 154(b) by 0 days.

(21) Appl. No.: 10/190,707

(22) Filed: Jul. 9, 2002

(65) Prior Publication Data

US 2003/0024655 A1 Feb. 6, 2003

(30) Foreign Application Priority Data

Aug. 1, 2001 (IT) ..... PD20010066 U

(51) Int. Cl.[7] ..... A47H 1/00

(52) U.S. Cl. ..... 160/107; 160/177 R; 160/310; 160/DIG. 17; 49/64

(58) Field of Search ..... 160/107, 168.1, 160/174 R, 177 R, 176.1, 355, 381, DIG. 17; 49/64

(56) References Cited

U.S. PATENT DOCUMENTS

| | | | | | |
|---|---|---|---|---|---|
| 3,578,794 | A | * | 5/1971 | Laird | 242/25 |
| 3,722,572 | A | * | 3/1973 | Hall | 160/107 |
| 4,459,778 | A | * | 7/1984 | Ball | 49/64 |
| 4,681,279 | A | * | 7/1987 | Nakamura | 242/107.3 |
| 4,687,040 | A | * | 8/1987 | Ball | 160/107 |
| 4,979,552 | A | * | 12/1990 | Van Der Zanden | 160/107 |
| 5,003,836 | A | * | 4/1991 | Mitsugu et al. | 74/425 |
| 5,004,961 | A | * | 4/1991 | Berner et al. | 318/65 |
| 5,467,266 | A | * | 11/1995 | Jacobs et al. | 364/167.01 |
| 5,769,142 | A | | 6/1998 | Nicolosi | |
| 6,095,223 | A | * | 8/2000 | Rossini et al. | 160/107 |
| 6,332,491 | B1 | * | 12/2001 | Rossini | 160/107 |
| 6,426,604 | B1 | * | 7/2002 | Ito et al. | 318/466 |
| 2002/0047347 | A1 | * | 4/2002 | Torii et al. | 310/68 |
| 2003/0089462 | A1 | * | 5/2003 | Wang | 160/107 |

FOREIGN PATENT DOCUMENTS

| | | | | |
|---|---|---|---|---|
| FR | 2659109 | * | 5/1990 | 160/107 X |
| FR | 2672335 | * | 4/1991 | 160/107 X |
| JP | 339259 | * | 5/1993 | 160/107 X |
| JP | 339260 | * | 5/1993 | 160/107 X |
| JP | 13957 | * | 6/1994 | 160/107 X |

OTHER PUBLICATIONS

Patent Abstracts of Japan vol. 017, No. 656 (M–1521), Dec. 6, 1993 & JP 05 214882 A (Nippon Sheet Glass Co Ltd), Aug. 24, 1993 *abstract*.

Patent Abstracts of Japan vol. 2000, No. 09, Oct. 13, 2000, & JP 2000 179257 A (Central Glass Co Ltd) Jun. 27, 2000 *abstract*.

Patent Abstracts of Japan vol. 1996, No. 05, May 31, 1996 & JP 08 013957 A (Central Glass Co Ltd; Others: 01), Jan. 16, 1996 *abstract*.

* cited by examiner

*Primary Examiner*—Bruce A. Lev
(74) *Attorney, Agent, or Firm*—Guido Modiano; Albert Josif; Daniel O'Byrne

(57) ABSTRACT

An actuation assembly for double-glazing units with a frame with two glazed panes that form a hermetic air space accommodating shutters movable to be gathered or rolled-up, which comprises rotary motion speed varying elements, with a first rotor, with a magnet ring external to the unit and a second rotor, with a magnet ring arranged inside the unit to surround coaxially thereto, the rotation shaft on which the cords, from which the shutters hangs, are wound.

10 Claims, 4 Drawing Sheets

ACTUATION ASSEMBLY FOR SHUTTERS INSIDE DOUBLE-GLAZING UNITS

BACKGROUND OF THE INVENTION

The present invention relates to an actuation assembly particularly for shutters inside double-glazing units.

As is known, double-glazing units are currently particularly appreciated because of their functional characteristics of thermal and acoustic insulation.

In particular, double-glazing units are glazing units of the type that comprises a perimetric frame that supports two parallel panes, at least partially transparent to light, and forming a hermetic air space between them.

In recent years, double-glazing units have been provided having shutter means for blocking light (Venetian blinds, pleated curtains, or the like) which are placed inside the air space and are moved from a fully gathered or rolled-up condition to opened-out condition by motor means, which are associated with the frame, or manually.

One of the main problems suffered by these double-glazing units is the transmission of the movement of the manual or automatic actuation means to the mechanisms for moving the shutter means without compromising the hermetic seal of the frame of the double-glazing unit.

SUMMARY OF THE INVENTION

The aim of the present invention is to provide an actuation assembly for shutters, such as Venetian blinds or the like in double-glazing units, that is compact and easy to apply to the structure of the double-glazing unit.

An object of the present invention is to provide an actuation assembly that can be configured easily in order to increase or reduce the speed produced by the actuation means, depending on whether they are manual or automatic.

Another object of the present invention is to provide an actuation assembly that is particularly adaptable to various types of double-glazing units.

Another object of the present invention is to provide an actuation assembly that can be manufactured with known technologies.

This aim and these and other objects that will become better apparent hereinafter are achieved by an actuation assembly particularly for shutters in double-glazing units with a perimetric frame that supports two glazed panes that form, between them, a hermetic air space that accommodates light blocking means adapted to be moved from a fully gathered or rolled-up condition to an opened-out condition, and viceversa, said assembly being characterized in that it comprises:

- means for generating a rotary motion and means for varying its speed;
- a first rotor, which is external to the double-glazing unit and whose rotation axis is perpendicular to the arrangement of the double-glazing unit;
- a second rotor, arranged inside the double-glazing unit, which surrounds, and is connected coaxially to, the rotation shaft on which the cords from which the lower end of said light blocking means hangs are wound;
- said first rotor comprising a ring of magnets with polarities that are aligned with its rotation axis and said second rotor comprising a ring of magnets with radial polarities.

BRIEF DESCRIPTION OF THE DRAWINGS

Further characteristics and advantages of the present invention will become better apparent from the following detailed description of an embodiment thereof, illustrated only by way of non-limitative example in the accompanying drawings, wherein.

DESCRIPTION OF THE PREFERRED EMBODIMENTS

Figure 2:
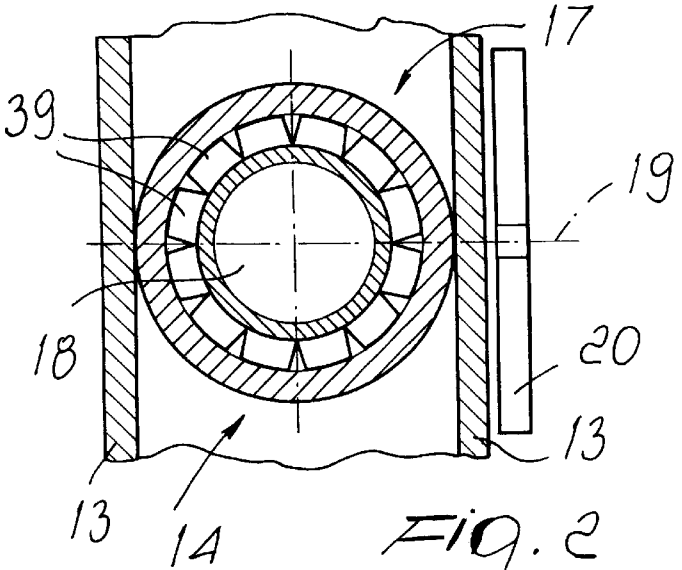
FIG. 2 is a sectional view of the double-glazing unit in the region of the actuation assembly, which is shown partially.

With reference to the figures, a double-glazing unit provided with an actuation assembly 10 according to the invention is generally designated by the reference numeral 11.

The double-glazing unit 11 comprises a perimetric frame 12, which supports two parallel glazed panes 13 that form, between them, a sealed air space 14 that accommodates light blocking means, which in this case are constituted by a Venetian blind, generally designated by the reference numeral 15.

The blind 15 is moved from a fully gathered condition or configuration to opened-out conditions or configurations and viceversa by an assembly 10 according to the invention, which is arranged in a corner region of the frame 12 and comprises means for generating a rotary motion and for varying speed, which will be described better hereinafter, and a first external rotor 16 with a rotation axis 19 that is perpendicular to the arrangement of the double-glazing unit 11.

The assembly 10 further comprises a second rotor 17, which is arranged inside the double-glazing unit 11 and is constituted by a ring of permanent magnets 39 with alternating radial polarities, which surrounds, and is rigidly coupled to, the rotation shaft 18 on which the cords 22, from which the lower end of the Venetian blind 15 hangs, are wound.

The shaft 18 is parallel to the panes 13 and therefore perpendicular to the axis 19 of the first rotor 16.

Said first rotor comprises an annular magnetic part, constituted for example by two or more permanent magnets 20 shaped like circular sectors, which form a ring and are mutually rigidly coupled with mutually alternating polarities, each having polarities aligned with the axis 19.

The magnets 20 are arranged downstream of speed varying means, which are constituted by an epicyclic speed changing unit 23 (in this case a step-up unit), which is connected to a manual cord-operated device 24 that constitutes a means for generating the rotary motion, or/and to an electric motor.

In greater detail, the first rotor 16 comprises the magnets 20, which face the corresponding pane 13 in a seat 25 of the body 26 of the speed changing unit 23, which is shaped on the opposite side so as to form the inner or internal ring 27, with which the planet gears 28 for kinematic connection to the sun gear 29 mesh.

The planet gears 28 rotate freely on respective pivots 30, which are inserted in a pulley 31 with which the motion actuation cord 37 engages.

The pulley 31 and the sun gear 29 are supported by a shaft 32, which rotates with respect to the body 26 with a bearing 33 interposed.

The shaft 32 is supported by the body 26 and, at the opposite end, by a seat 34 formed in an axial hood 35 that encloses the entire system, entering with the edge 36 at an abutment step 38 of the body 26.

As an alternative, when it is necessary to reduce the speed in order to use the electric motor as the source of motion (or any source with a high rotation rate), the pulley with which said source engages can be rigidly coupled to the sun gear instead of being coupled to the planet gear.

Figure 3:
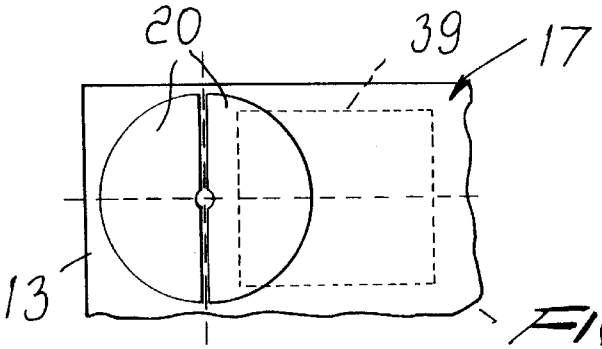
FIG. 3 is an enlarged-scale view of a front detail of the mutual arrangement of the rotors.
Figure 1:
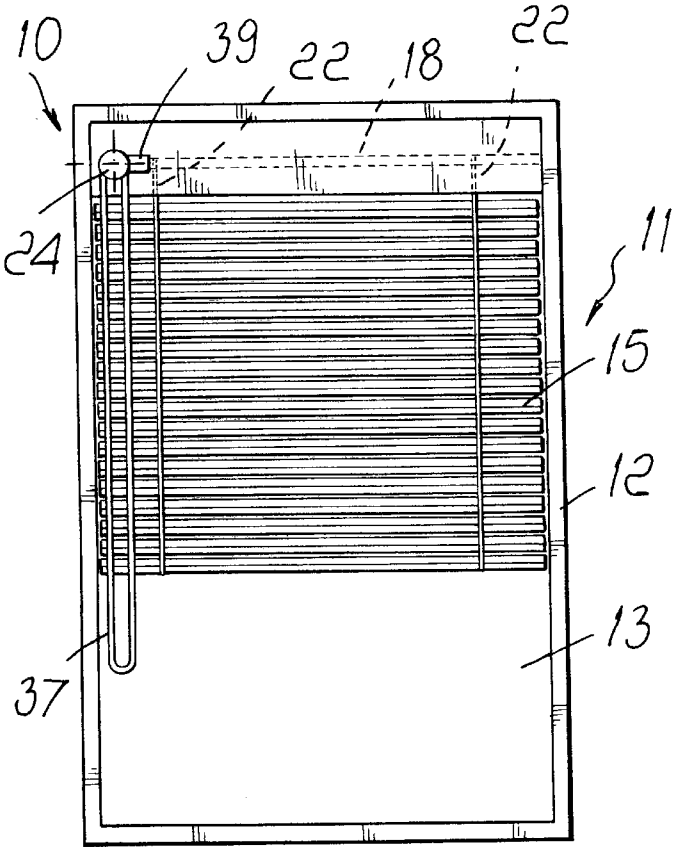
FIG. 1 is a front view of a double-glazing unit provided with an assembly according to the invention.
Figure 4:
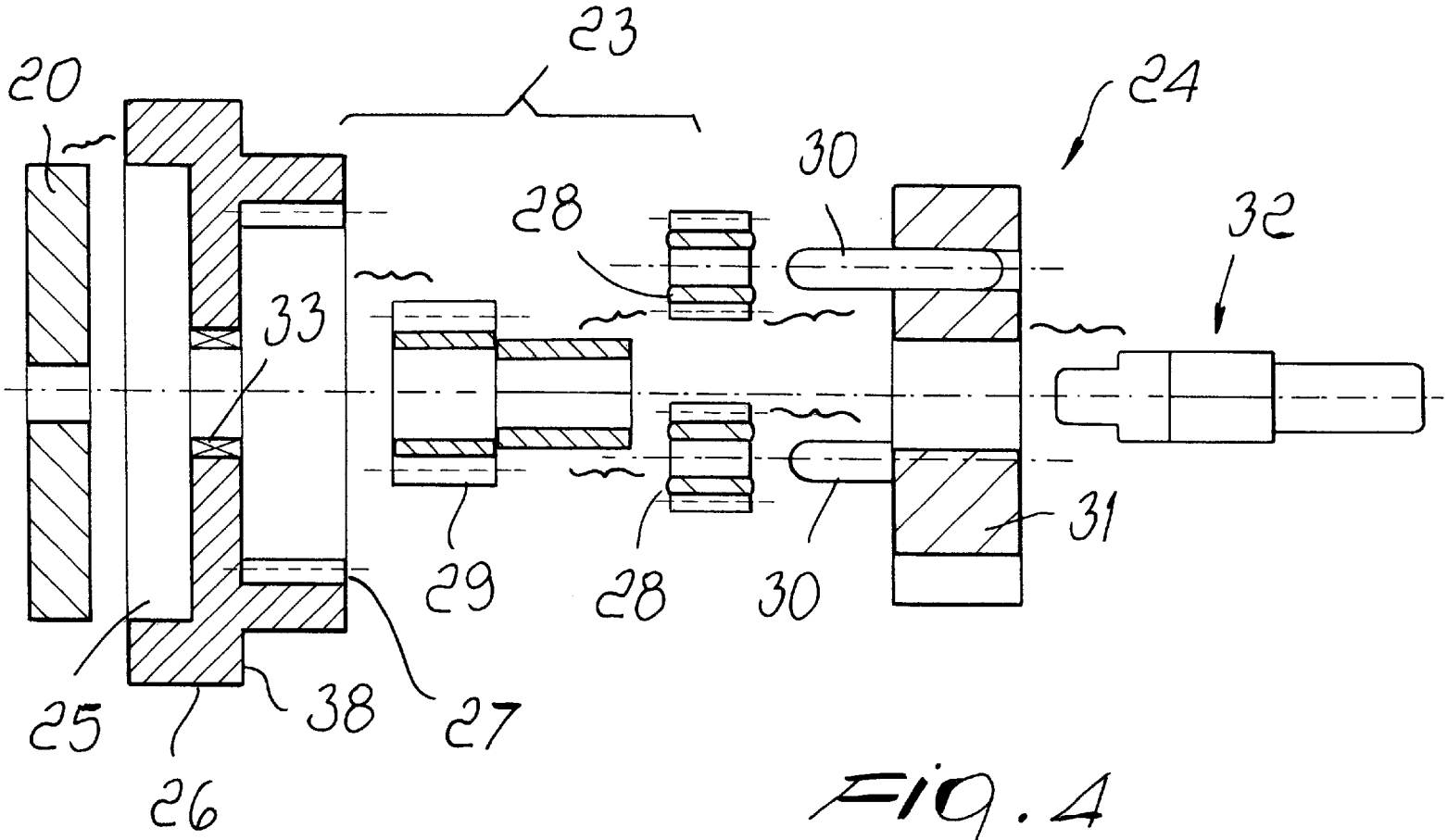
FIG. 4 is an exploded sectional view of the part of the assembly according to the invention that lies outside the double-glazing unit.
Figure 5:
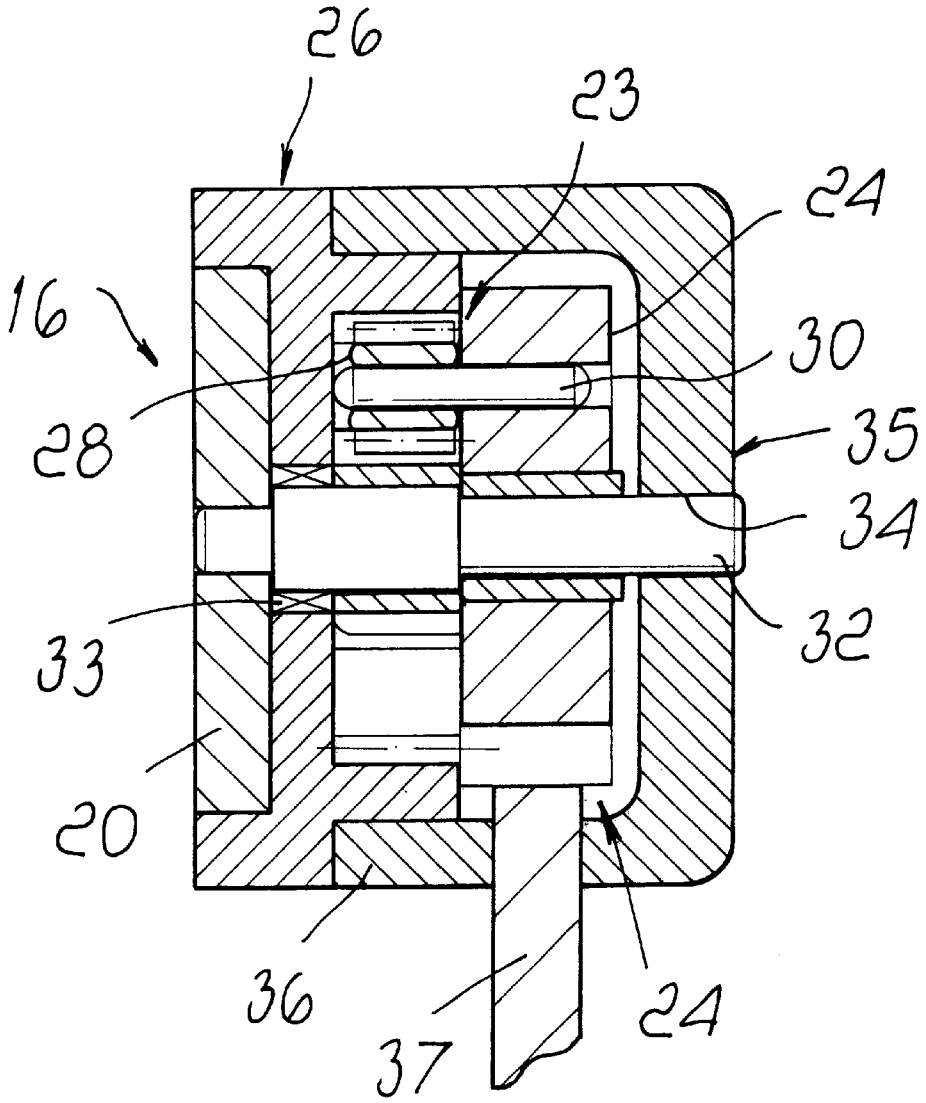
FIG. 5 is a sectional view, in assembled condition, of the part of the assembly according to the invention that lies outside the double-glazing unit.
Figure 6:
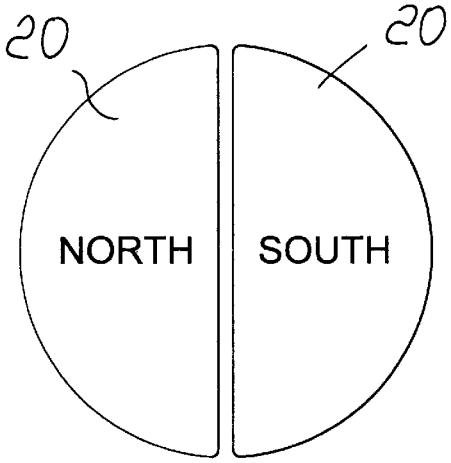
FIGS. 6 and 7 are respective schematic views of the arrangement of the magnets of a first rotor comprised within the assembly.
Figure 7:
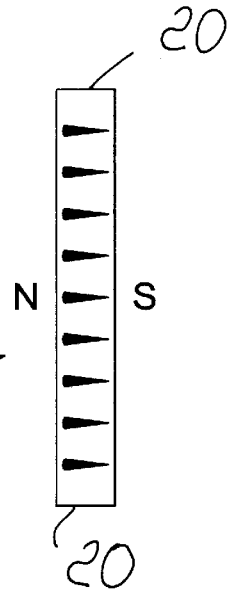
Figure 8:
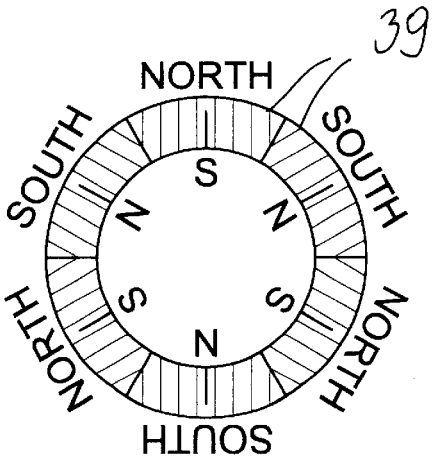
FIGS. 8 and 9 are respective schematic views of the arrangement of the magnets of a second rotor comprised within the assembly.
Figure 9:
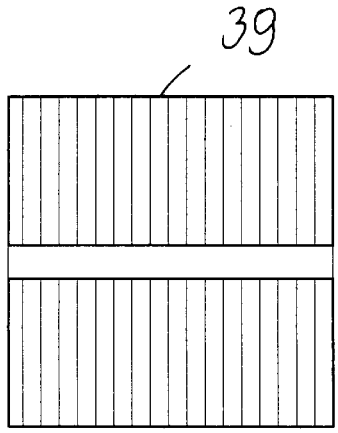

FIG. 3 illustrates the mutual arrangement of the rotors, which is configured so that a rotation of the first rotor 16 causes, by magnetic attraction, a rotation of the second rotor 17 even if it is arranged at right angles.

In particular, the second rotor 17 is arranged so as to overlap half of the first rotor 16, in order to allow an effective action of its magnetic field on the magnetic field of the other rotor so as to achieve motion transmission.

In practice it has been observed that the present invention has achieved the intended aim and objects.

In fact, the actuation assembly is compact and can be accommodated easily in the structure of the double-glazing unit.

Moreover, it can be used, in the case of the Venetian blind, both for opening/gathering and for orientation of the slats.

The presence of the speed changing unit in fact allows, both when stepping up and when stepping down, to have a rotation rate that is suitable for both functions.

Moreover, the assembly can be configured easily to increase or reduce the speed produced by the actuation means, depending on whether the user prefers them to be of the manual or automatic type.

The materials employed, as well as the dimensions, may be any according to requirements.

The disclosures in Italian Utility Model Application No. PD2001U000066 from which this application claims priority are incorporated herein by reference.

What is claimed is:

1. A double-glazing window unit in combination with an actuation assembly, said double-glazing unit having shutters and a perimetric frame supporting two glazed panes which form, therebetween, a hermetic air space, in which light blocking means of said shutters are accommodated that are actuatable from a fully gathered or rolled-up configuration to opened-out configurations, and viceversa, the actuation assembly comprising:

motion means for generating a rotary motion;

speed changing means for varying rotation speed, said speed changing means being constituted by an epicyclic speed changing unit arranged outside the double-glazing unit;

a first rotor, external to the double-glazing unit, which has a rotation axis perpendicular to an arrangement plane of the double-glazing unit;

a rotation shaft with cords, from which a lower end of said light blocking means hangs, wound thereon;

a second rotor, arranged inside the double-glazing unit, which surrounds, and is connected coaxially to said rotation shaft; and wherein said first rotor comprises a ring of magnets with polarities that are aligned with said rotation axis of the first rotor, and said second rotor comprises a ring of magnets having radial polarities.

2. The combination of claim 1, wherein said magnets of said first rotor are shaped as circular sectors which are arranged with mutually alternating polarities, each said magnet of the first rotor having polarities aligned to said rotation axis of the first rotor.

3. The combination of claim 2, wherein said magnets of said first rotor are arranged downstream of said epicyclic speed changing unit.

4. The combination of claim 3, wherein said second rotor is arranged so as to overlap half of the first rotor.

5. The combination of claim 4, further comprising a manual device for generating the rotary motion, said epicyclic speed changing unit being connected to said manual device.

6. The combination of claim 5, wherein said manual device is a cord-operated device.

7. The combination of claim 4, further comprising an electric motor for generating the rotary motion to which said epicyclic speed changing unit is connected.

8. A double-glazing window unit in combination with an actuation assembly, said double-glazing unit having shutters and a perimetric frame supporting two glazed panes which form, therebetween, a hermetic air space, in which light blocking means of said shutters are accommodated that are actuatable from a fully gathered or rolled-up configuration to opened-out configurations, and viceversa, the actuation assembly comprising:

motion means for generating a rotary motion;

speed changing means for varying rotation speed, said speed changing means being constituted by an epicyclic speed changing unit arranged outside the double-glazing unit;

a first rotor, external to the double-glazing unit, which has a rotation axis perpendicular to an arrangement plane of the double-glazing unit;

a rotation shaft with cords, from which a lower end of said light blocking means hangs, wound thereon;

a second rotor, arranged inside the double-glazing unit, which surrounds, and is connected coaxially to said rotation shaft; and said first rotor compring a ring of magnets with polarities that are aligned with said rotation axis of the first rotor, and said second rotor comprising a ring of magnets having radial polarities;

said epicyclic speed changing unit comprising: a body shaped at a first end thereof so as to form an internal ring, and at a second, opposite end so as to form a seat for accommodating said ring of magnets of said first rotor arranged to face a corresponding pane; a sun gear; a pulley actuated by said motion means; pivots rigidly coupled to said pulley; planet gears supported so as to rotate freely on respective ones of said pivots and meshing wit said internal ring and wit said sun gear; an axial hood connected to said body so as to enclose the planet gears and the sun gear and having a supporting seat; a bearing supported in said body; and a shaft, supported at a first end in said bearing and at a second end in said supporting seat of said hood, said pulley and said sun gear being supported uncoupled from each other, for free rotation, on said shaft.

9. The combination of claim 8, wherein said motion means are capable of a manual operation.

10. The combination of claim 8, wherein said motion means are capable of a motorized operation.

* * * * *